United States Patent [19]

Edwards

[11] Patent Number: 4,464,664

[45] Date of Patent: Aug. 7, 1984

[54] RADIO ANTENNA AND CONNECTOR APPARATUS

[75] Inventor: Ralph W. Edwards, Dayton, Ohio

[73] Assignee: General Motors Corporation, Detroit, Mich.

[21] Appl. No.: 405,179

[22] Filed: Aug. 4, 1982

[51] Int. Cl.[3] ..... H01Q 1/32; H01Q 1/10

[52] U.S. Cl. ..... 343/715; 343/906; 343/903

[58] Field of Search ..... 343/711, 713, 714, 715, 343/889, 901, 903, 900, 877, 906; 174/138 A, 152 A, 153 A; 339/9 A, 177 R, 177 E

[56] References Cited

U.S. PATENT DOCUMENTS

| | | | |
|---|---|---|---|
| 2,499,137 | 2/1950 | Friedberg et al. | 343/889 |
| 2,632,106 | 3/1953 | Carlson | 343/889 |
| 2,695,957 | 11/1954 | Cone | 343/714 |
| 2,763,340 | 9/1956 | McDonnell et al. | 343/903 |
| 2,840,816 | 6/1958 | Cejka | 343/715 |
| 2,923,908 | 2/1960 | Cejka | 339/177 E |

*Primary Examiner*—Eli Lieberman
*Assistant Examiner*—Michael C. Wimer

[57] ABSTRACT

A connector apparatus for automotive vehicle antenna assemblies includes a free floating pin terminal telescopically related with a female terminal socket and biased into electrical contact at a distal head portion thereof with the antenna mast under the compression of an elastomeric seal member squeezed between a shoulder of the floating terminal element and the end fitting of the female element.

2 Claims, 3 Drawing Figures

RADIO ANTENNA AND CONNECTOR APPARATUS

This invention relates to electrical connectors and more particularly to automotive vehicle radio antennas and connectors therefor.

A popular type of automotive vehicle radio antenna of the power operated type, having a telescopic mast which may be automatically movable between retracted and extended conditions as when the radio is switched on and off, is generally structured with an outer shielding tubular extension of the automatic motor drive apparatus long enough to enclose the mast when in retracted position, in fixed generally concentric relation therewith. As a consequence of such arrangement of parts it is further typical to provide radio frequency conductor cable fittings routed through the vehicle body to the lower section of the antenna mast and which must pass on a lateral or radial axis through the shield tube to make such connection. Such conductor fitting typically comprises a male/female set of terminal elements, one of which is welded to the lower mast section to project radially thereof to or through a terminal aperture provided at the selected location in the shield tube.

While such arrangement of parts has been generally effective for its intended purpose the welding of a radio frequency terminal element directly upon the antenna mast assembly has led to a high rate of scrappage of the mast in manufacture, due to distortion of the fairly delicate shapes and sizes of interfitting telescopic metal sleeves in the mast when any thereof are subjected to the heat and metal flow of the weld operation.

Further, various models of automobiles often require various placements of the conductor fitting elements on the antenna assembly for ease of installation, and proliferation thereby results in what is otherwise a single broadly applicable antenna assembly. Such proliferation is particularly to be avoided in the replacement market.

It is an object of the present invention to avoid such difficulties yet retain the general nature and constituency of parts and features which have otherwise proven more than satisfactory for the described antennas. Thus, in somewhat more specific aspects, the present invention follows practice in the art wherein an elastomeric seal annulus is seated between a conductor fitting part on the shield tube and another on the lower mast section. Such prior practice utilized the annulus solely as a means for preventing ingress of moisture and other contaminants to the area of the mating male/female radio frequency conductor terminals. In the present invention, such elastomeric annulus is utilized in combination with radio terminal elements which have no welded or other fixed relation on the fixed mast section. Rather, the same are held completely separate with respect thereto. Upon installation, the conductor terminal elements are placed in electrical conducting relation with the antenna, and the elastomeric annulus performs the function of establishing such relation of parts without any need for welds or the like, as well as sealing the same such as was done formerly.

The invention features a conductor cable assembly structured with a terminal end fitting attached to the shield tube and having an abutment surface located in fixed relation therewith, with the lower antenna mast selection also held in a fixed relationship with the shield tube. A first connector termnal is located inside the terminal fitting and another terminal is telescopically mated therewith and provided with a shoulder surface facing the connector fitting abutment surface. The distance between such surfaces and the thickness of the elastomeric seal are so related that when these several parts are installed in axially aligned relationship on a lateral axis of the antenna assembly, the annulus becomes compressed and provides the necessary bias against the shoulder of the mated terminal element to urge the latter telescopically onto and against the lower mast section for firm electrical contact.

Thus, not only is the need for welding eliminated and scrappage thereby avoided but further the resulting assembly of parts is versatile in adapting a single antenna apparatus to use in a variety of vehicle installations, requiring only the provision of a like variety of available apertures on various lateral axes of the shield tube to choose from for the most convenient conductor cable routing and simple resilient engagement of conductor terminals with the lower mast section at any such selected location.

These and other objects, features and advantages of the invention will be readily apparent from the following specification and from the drawings wherein.

Figure 1:
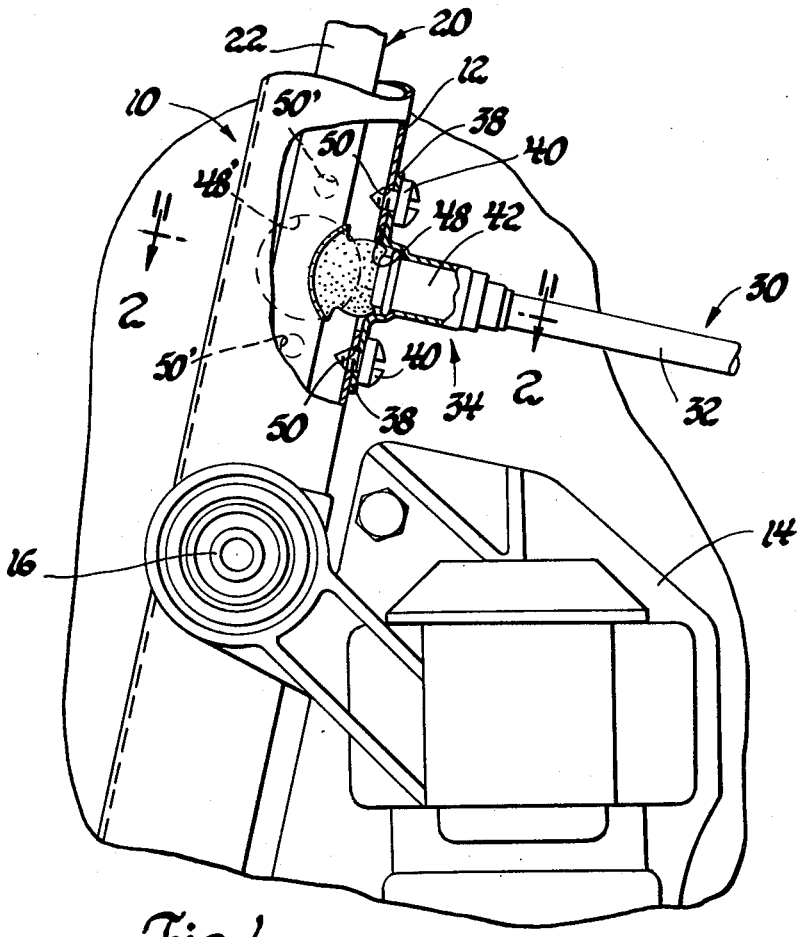
FIG. 1 is a fragmentary view of a power operated automotive radio antenna assembly including connector apparatus therefor in accordance with the invention.

Referring now to FIG. 1 of the drawings, the same illustrates a well known variety of power operated automotive radio antenna assembly of the type including an inner telescopic multi-section mast receptor which when not in use is withdrawn within the vehicle body and which telescopically extends to project therefrom at the remote command of the driver. The assembly is adapted for installation in a concealed location in interior spaces of the vehicle body such as between inner and outer front fender panels or rear quarter panels thereof. The antenna apparatus is designated generally as 10 and includes a shield tube 12 and a motor housing 14 of die cast or like construction adapted as at connecting bosses 16 to have rigid assembled relation with the shield tube. As is well known, such sheld tube extends upwardly to the surface of the outer vehicle body panel. Housing 14 includes a reversible d.c. electric motor operable at the command of the vehicle driver to cause extension or retraction of a cable or the like connected with the vehicle antenna mast thus to in turn extend or retract such mast as well known in the art. The antenna mast is indicated generally at 20 in FIG. 1 and typically comprises a series of three or more telescopically movable tubular sections in electrical contact, best indicated in FIG. 2, all housed within and movable with respect to a stationary section 22 constituting the lower telescopic section of the mast. In the case of this invention, this lower section 22 is assembled within the shield tube 12 in fixed relation therewith and held closely concentric thereto so as to have a nearly uniform annular gap therearound as illustrated in the broken away section of FIG. 1. The telescopically movable sections of the mast assembly have electrical contact with the lower section 22 as by contact fingers or the like as well known.

In accordance with the present invention the antenna assembly 10 is provided with electrical connector apparatus extending to the vehicle ratio receiver, not shown, located in the instrument panel or otherwise. Such connector apparatus is designated generally as 30 and includes a length of coaxial cable 32 of a length sufficient to extend to such receiver, the cable being provided with an end fitting designated generally as 34. This fitting generally comprises an attachment housing 36 provided with parti-cylindrical ears 38 and screw fasteners 40 attaching such ears to shield tube 12. An intermediate cylindrical shell 42 is interferingly pressed in electrical engagement within the tubular portion of housing 36, and an insulator therewithin of nylon or similar polymeric material 44 with a countersunk entrance bore in turn enclosing a socket or female radio frequency terminal element 46. Terminal 46 is slotted to provide resilient contact fingers in well known manner and the shell 42 and such terminal 46 are electrically joined with the two conductor elements of cable 32 in a manner not shown but well known in the art.

As seen best in FIG. 1, shield tube 12 is provided with one or more sets of connector apertures 48 and 48' and screw fastener perforations such as indicated at 50 and 50'. These apertures and perforations may be provided at various angular positions around the periphery of the shield tube and along its length, as may be dictated by the various installation situations encountered from vehicle model to vehicle model, to enable best routing of the coaxial cable 32 in the space available within the vehicle body panels. Thus, with the connector apparatus 30 of this invention it is contemplated that the end fitting 34 of the cable is to be fitted to the sheld tube on any selected one of several axes directed laterally or radially of the shield tube at apertures 48. To complete the connector apparatus installation at a selected aperture 48, there is provided a floating terminal subassembly including an elongated second radio frequency pin-type terminal element 52 and an elastomeric annular member 54. In the illustrated embodiment, the terminal element 52 is the male piece having the shank or plain end thereof received and held firmly telescopically in electrical contact within the resilient legs of the female terminal 46. Adjacent its other end, the floating terminal element 52 is provided with a rounded head 56 on a disk-like portion presenting a shoulder surface 58 on the underside thereof.

Figure 3:
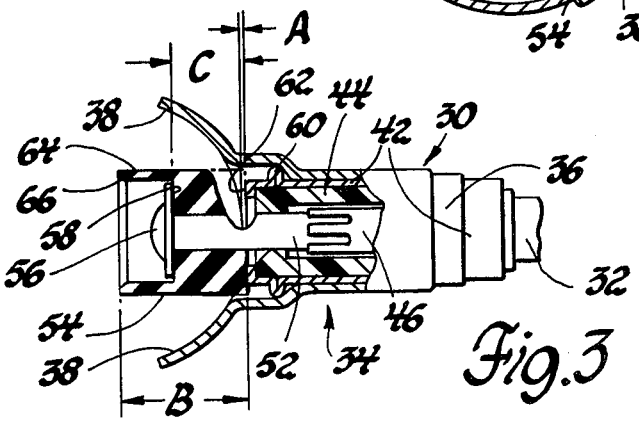
FIG. 3 is a view similar to FIG. 2 showing the connector apparatus disassembled from the antenna assembly.

Referring to FIG. 3, it is contemplated that the connector apparatus may first be assembled as shown therein, such that the member 54 is interposed and yieldably held between the shoulder 58 and the exposed end of the shell 42 of end fitting 34. If thought necessary for subassembly retention purposes, the entrance bore of insulator 44 may be made tight on the shank of terminal 52 or a light cement applied thereto as the connector apparatus is built up. Shell 42 is formed with a crimped bead 60 fitted against a shoulder of housing 36 defined by the enlarged diameter portion thereof. As will be seen, the abutment of the inner end of seal member 54 on the exposed end surface 62 of shell 42 dictates that such surface 62 be preferably located a predetermined distance "A" from the nearby axis intersection point of the parti-cylindrical surface of ears 38 of the housing, as seen in FIG. 3. This is controlled by fairly close tolerance on the distance between end surface 62 and bead 60 as well as the distance between that axis point of the surface of ears 38 and the enlarged diameter shoulder of the tubular portion of housing 36.

The member 54 is constituted of a solid annular body interposed between shoulder 58 and end surface 62 and which has an extending thin, flexible, integral skirt 64 provided with a chamfered end as at 66. The skirt defines a recess at one end of the seal member suitable for sealing of terminal 52 as will be described. Upon installation of the connector apparatus 30 on shield tube 12, the rounded head 56 of terminal 52 is caused to engage stationary section 22 of the mast assembly, and upon such engagement, due to an overlarge dimension of the seal member 54 as will be described, the same must be compressed as the screw fasteners 40 are installed and the ears 38 of housing 36 brought up tightly on the shield tube.

Figure 2:
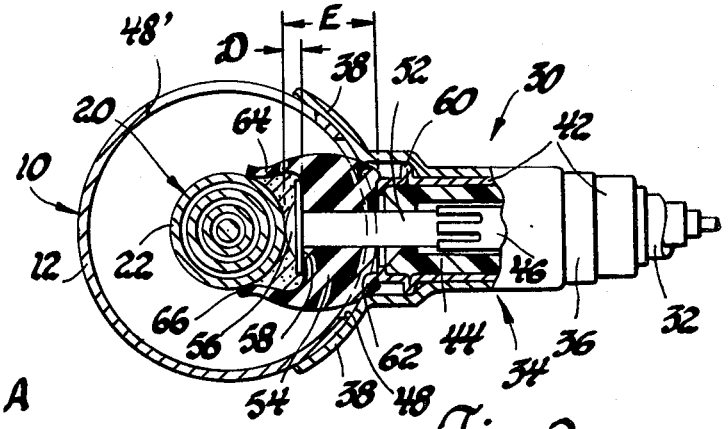
FIG. 2 is an enlarged sectional view partially broken away and taken generally in the plane indicated by lines 2—2 of FIG. 1.

More specifically, referring to FIG. 3, the member 54 is provided with an overall length "B" in its uncompressed state and an intermediate length "C" for its annular body portion. Referring to FIG. 2, the head 56 of terminal element 52 has an axial dimension "D" to the undersurface of its shoulder 58. The distance "E" between the surface of the stationary lower mast section 22 and end surface 62 of the shell 42 is so related with the uncompressed body length "C" of the seal member that the tightening of the screw fasteners 40 with the head 56 pressed against the lower mast section causes the body of the member 54 to be resiliently compressed. Stated otherwise, axial dimension "C" of the uncompressed member 54 is predeterminedly larger than the fixed gap between shoulder surfaces 58 and 62, i.e., $C>(D-E)$, that the elastic member must be squeezed during the installation. Accordingly, upon installation, head 56 of the floating terminal element 52 of the connector apparatus is biased into intimate electrical contact with the mast assembly 20. In addition, the elastomeric member 54 serves as a seal against the ingress of moisture or other foreign elements to the interior of the shell 42, either by way of end surface 62 or the undersurface of shoulder 58. Corrosion or other degradation of the electrical engagement of the male and female terminal elements is therefore inhibited. The result is a complete freedom from the weld problems of the prior art, and the proliferation problems aforedescribed, and additionally quite satisfactory weather sealing is established around the electrical parts. All this is done with a very simple and economical structure.

Additionally, the cup or recess of member 54 defined by skirt 64 thereof is further adapted to act as a seal for the contact head 56 against lower mast section 22. As seen in FIG. 2, such cavity is filled with a suitable dielectric silicone grease or equivalent compound which, when the connector apparatus 30 is installed, is caused to be held within such cavity by the intimate gripping of the surface of lower mast section 22 by the chamfered end of skirt 64. Thus, the skirt length, dimension "B" minus "C", is sufficiently overlong with respect to the gap between shoulder 58 and the curved surface of the mast section that the skirt is caused to yield or pucker, as seen best in FIG. 1, to intimately engage such surface and hold the grease pack within its cavity. With or without such grease pack, the skirt serves as an effective seal against the ingress of moisture and other contaminants to the interior portion of the seal member.

While a variety of elastomeric polymer materials may be selected for seal member 54, a silicone rubber is a preferred material and such silicone material may be oil impregnated so as to provide additional seal protection to the electrical areas interior of surface 62 arising from coating on such surfaces of the impregnated oil. Alternatively, a dielectric grease may also be packed within the cavity of housing 36 adjacent bead 60 to provide such protection.

The embodiments of the invention in which an exclusive property or privilege is claimed are defined as follows:

1. In an automotive radio antenna of the type including an outer tube, a mast antenna disposed within said tube including an interior portion mounted in fixed relation therewith in directions radially thereof, connector apparatus comprising, means defining one or more apertures in the wall of said tube, a conductor cable assembly including a terminal end fitting adapted to be affixed to said tube over an aperture therein and having an annular abutment surface adapted when so affixed to be located a predetermined distance from said fixed mast portion and further having an interior electrical connector element, an elongated second electrical connector element movable with respect to said fixed mast portion and axially projecting through said aperture and telescopically received at one end thereof in electrical contact upon said interior element, means defining upon said second element a predetermined distance from the other end thereof a shoulder facing said abutment surface, and an elastomeric annulus received over the shank of said second element and interposed between the shoulder of the latter and said abutment surface of the terminal end fitting, the uncompressed length of said annulus so interposed being so related with the two said distances that upon fixing of said terminal end fitting to said tube said annulus is elastically compressed whereby said second element is held biased relative said interior element in electrical contact at said other end thereof with said fixed mast portion and further whereby said annulus seals said terminal end fitting from the ambient.

2. In an automotive radio antenna of the type including an outer tube, a mast antenna disposed within said tube including a cylindrical interior portion mounted in fixed relation therewith in directions radially thereof, connector apparatus comprising, means defining one or more apertures in the wall of said tube, a conductor cable assembly including a terminal end fitting adapted to be affixed to said tube on an axis lateral thereto and over an aperture therein on such axis and having an annular abutment surface adapted when so affixed to be located a predetermined distance from said fixed mast portion, said fitting further having an interior electrical connector element, an elongated second electrical connector element projecting through said aperture on said axis and movable therealong with respect to said fixed mast portion and having a shank telescopically received in electrical contact upon said interior element, said second element further including a rounded electrical contact head having a shoulder facing said abutment surface, and an elastomeric annulus recessed at one end and received over the shank of said second element so that said contact head is located in its end recess and with the solid body of the annulus interposed between the shoulder of the latter and said abutment surface of the terminal end fitting, the solid body of said annulus so interposed being of a size such that upon fixing of said terminal end fitting to said tube said annulus solid body is elastically compressed whereby said second element is held biased relative said interior element in electrical contact at said head thereof with said fixed mast portion and further whereby said annulus solid body seals said terminal end fitting from the ambient, the end recess of said annulus being defined by a flexible thin skirt thereof which extends along said lateral axis into compressed engagement with the cylindrical surface of said fixed mast portion to flex over the contour thereof and seal said contact head from the ambient.

* * * * *